US006955148B2

(12) United States Patent
Rosenzopf et al.

(10) Patent No.: US 6,955,148 B2
(45) Date of Patent: Oct. 18, 2005

(54) INTERNAL COMBUSTION ENGINE CONTROLLER AND METHOD FOR THE OPERATION OF AN INTERNAL COMBUSTION ENGINE CONTROLLER

(75) Inventors: Guenter Rosenzopf, Ludwigsburg (DE); Helmut Denz, Stuttgart (DE); Karsten Kroepke, Ludwigsburg (DE); Ruediger Weiss, Moetzingen (DE); Oliver Heyna, Bietigheim-Bissingen (DE); Stephan Rosenberg, Farmington Hills, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/433,306

(22) PCT Filed: Aug. 8, 2002

(86) PCT No.: PCT/DE02/02921

§ 371 (c)(1),
(2), (4) Date: Nov. 12, 2003

(87) PCT Pub. No.: WO03/031790

PCT Pub. Date: Apr. 17, 2003

(65) Prior Publication Data

US 2004/0060546 A1 Apr. 1, 2004

(30) Foreign Application Priority Data

Oct. 2, 2001 (DE) ..... 101 48 646

(51) Int. Cl.[7] ..... F02N 17/00
(52) U.S. Cl. ..... 123/179.17; 123/497

(58) Field of Search ..... 123/446, 179.16, 123/179.17, 497

(56) References Cited

U.S. PATENT DOCUMENTS

| | | | | | |
|---|---|---|---|---|---|
| 4,165,727 | A | * | 8/1979 | Fitzner et al. | 123/179.3 |
| 5,651,347 | A | * | 7/1997 | Oi et al. | 123/487 |
| 5,927,253 | A | * | 7/1999 | Oyafuso et al. | 123/456 |
| 6,269,801 | B1 | * | 8/2001 | Channing | 123/516 |
| 6,314,947 | B1 | * | 11/2001 | Roche | 123/525 |
| 6,581,574 | B1 | * | 6/2003 | Moran et al. | 123/497 |

FOREIGN PATENT DOCUMENTS

| | | | | |
|---|---|---|---|---|
| DE | 19961298 | * | 6/2001 | F02D/41/06 |
| DE | 10014550 | * | 10/2001 | F02M/37/08 |

* cited by examiner

*Primary Examiner*—Thomas Moulis
(74) *Attorney, Agent, or Firm*—Kenyon & Kenyon

(57) ABSTRACT

An internal combustion engine controller includes a main processor for monitoring operating parameters of an internal combustion engine and a triggering device, working together with the main processor, for an electric fuel pump of the internal combustion engine. The triggering device works together with an electric activation device and operates so that the fuel pump is triggered essentially without time delay after actuation of the activation device. The internal combustion engine controller has an electronic switching device which operates so that, during an initialization process of the main processor, it triggers the electric fuel pump independently of the main processor.

63 Claims, 3 Drawing Sheets

INTERNAL COMBUSTION ENGINE CONTROLLER AND METHOD FOR THE OPERATION OF AN INTERNAL COMBUSTION ENGINE CONTROLLER

FIELD OF THE INVENTION

The present invention relates to an internal combustion engine controller, and to a method for the operation of an internal combustion engine controller.

BACKGROUND INFORMATION

Such an internal combustion engine controller is referred to in German Published Patent Application No. 44 25 986. There, the electric fuel pump is triggered depending on the monitoring of specific operating parameters of the internal combustion engine, namely, the supply voltage and the rotational speed. It is thereby ensured that the fuel pump builds up the fuel pressure quickly after the controller is switched on. Due to the checking of the operating parameters, and additionally because of the duration of the initialization process of the triggering device, the electric fuel pump in the case of the internal combustion engine controller according to German Published Patent Application No. 44 25 986 is only actually triggered a certain time after the buildup of the supply voltage, and thus, if the ignition lock is rotated quickly, also a certain time after the activation of the starter coupled to the desire by a user to start. This results in a delayed fuel-pressure buildup in the internal combustion engine after a start input by the user, given a quick rotation of the ignition lock.

In other internal combustion engine controllers from the market, the fuel pump may be triggered simultaneously with the actuation of the starter. In this case, as well, because of the drop in the supply voltage caused by the starter actuation, the fuel pump is unable to immediately build up the necessary fuel pressure, which brings with it disadvantages with respect to the starting performance and the emission values of the internal combustion engine.

SUMMARY OF THE INVENTION

Therefore, with the exemplary embodiment of the present invention, after the internal combustion engine controller is switched on and the immediately subsequent start input by the user, the starting process may be carried out with as little time delay as possible, accompanied by sufficient fuel pressure.

According to the exemplary embodiment and/or method of the present invention, the fuel pump is switched on essentially without time delay after the activation of the internal combustion engine controller. Therefore, the internal combustion engine may be started by the starter immediately after the start input by the user; however, it may additionally also be delayed compared to the start input by the user. Because the fuel pump is initially triggered independently of the main processor, the initialization of the main processor does not delay the triggering of the fuel pump. Therefore, the fuel pump is triggered immediately, and is able to quickly provide the fuel pressure necessary for the start.

An internal combustion engine controller according to the present invention may exhibit increased operational reliability.

A switching device according to the present invention may prevent repeated triggering of the fuel pump within a short time span, so that irregular operating states while starting the internal combustion engine, which may come about, for example, due to an operating error by the user or because of a malfunction in the triggering, are prevented.

A speed sensor according to the present invention may permit simple monitoring as to whether a start has taken place.

A hardware logic circuit according to the present invention may exhibit a high speed of operation.

A logic circuit according to the present invention may ensure in a simple manner that after the main processor has been initialized, it is able to take over the triggering of the fuel pump.

The logic circuit according to the present invention may allow simple monitoring of changes in the operating state of the triggering device. In this context, the fuel pump is triggered via the activation input only in the case of operating states which lie within certain default values, so that an H-level (high level) is present at the further input of the AND element (or arrangement).

A bistable initialization toggle switch is an embodiment of the logic switch element (or arrangement) having precise switching performance; in addition, an unintentional triggering of the electric fuel pump may be prevented when the internal combustion engine is at a standstill.

Given somewhat lesser demands on the precision of the switching performance, an inexpensive RC element (resistance-capacitance element (or arrangement)) according to the present invention may also be used as an alternative.

The operational reliability of the internal combustion engine controller is further increased by the use of a disturbance-state toggle switch according to the present invention.

A power supply of the disturbance-state toggle switch according to the present invention may ensure a long-term monitoring of a disturbance state.

Alternatively, when lower demands are placed on the switching precision, an inexpensive RC element (or arrangement) according to the present invention may also be used for monitoring the disturbance state.

A logic circuit according to the present invention provides a static triggering of the electric fuel pump for the internal combustion engine controller according to the exemplary embodiment and/or method of the present invention.

For an electric fuel pump controlled in a pulse-width-modulated fashion, a switching device according to the present invention may ensure that, during the triggering of the fuel pump taking place independently of the main processor, a pulse-width-modulated triggering of the fuel pump is possible, attuned to the specific fuel pump.

A pulse duty factor according to the present invention may result in the fastest possible attainment of a predefined fuel pressure.

A logic module according to the present invention may lead to a very flexibly usable triggering of the internal combustion engine independently of the main processor.

Alternatively to a pure hardware logic circuit as electronic switching device, a triggering processor according to the present invention may also be used. This occurs when it has a small initialization time, and slight delays in the triggering of the fuel pump can be tolerated. The flexibility of the switching device is thereby increased, since the triggering processor may fulfill additional functions which are not able to be implemented with the aid of a pure hardware logic circuit, or may be implemented only with high expenditure. At the same time, since the initialization of the triggering processor is short compared to that of the more complexly constructed main processor, the time delay between the start input by the user and the buildup in fuel pressure is still shortened.

A triggering processor according to the present invention may offer the possibility of a simple storage for operating states, for example, when it has no storage modules permanently supplied with power. Naturally, a storage of this type may also be effected by suitable, continuously supplied flip-flops or by other electronic components.

A time-delay element (or arrangement) according to the present invention may ensure that the fuel pump is able to generate a predefined fuel pressure before the starter is triggered. Since with the internal combustion engine controller according to the exemplary embodiment and/or method of the present invention, the fuel pump is able to achieve the predefined fuel pressure very rapidly, only a very small delay time is necessary for triggering the starter.

A delay time according to the present invention may prove to be sufficient.

An exemplary method of the present invention provides a method for the operation of an internal combustion engine controller of the type indicated at the outset. The advantages of the method are yielded from the described advantages of the internal combustion engine controller.

DETAILED DESCRIPTION

Figure 1:
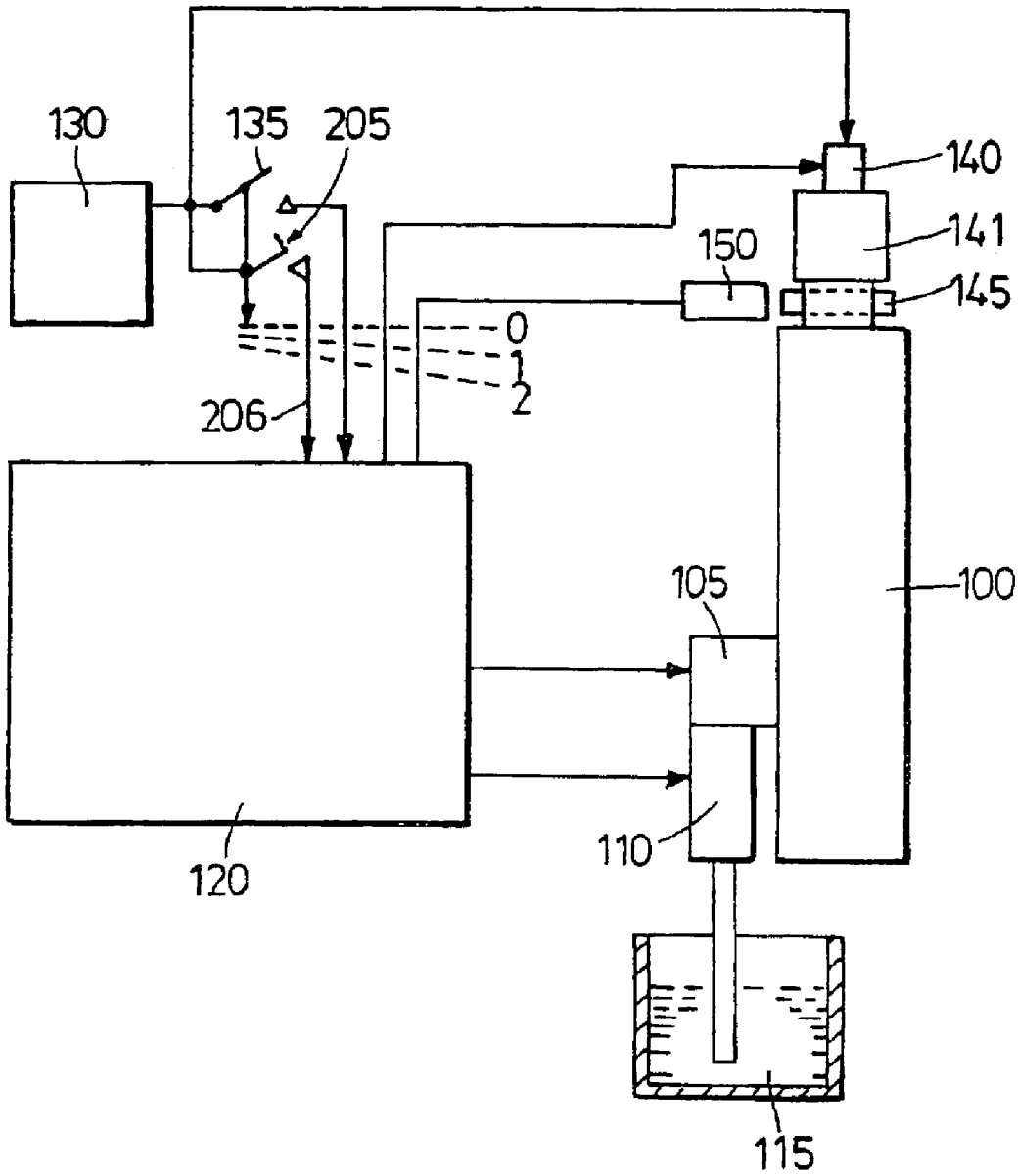
FIG. 1 shows schematically an internal combustion engine having an internal combustion engine controller according to the exemplary embodiment of the present invention.

Fuel is metered via a fuel-metering device 105 to an internal combustion engine, designated as a whole by 100 in FIG. 1. An electric fuel pump (EFP) 110 delivers the fuel from a storage tank 115 and makes it available to fuel-metering device 105. Fuel-metering device 105 and fuel pump 110 are triggered by an internal combustion engine controller 120.

From a battery 130, internal combustion engine controller 120 receives a supply voltage, able to be switched in by an ignition lock, i.e. an activation device 205, by way of an activation line 206. The latter is also used as a trip-on signal for internal combustion engine controller 120. By way of a starter switch 135 and internal combustion engine controller 120, battery 130 is switched through to starter 141 by an electromagnetic switch 140. In this context, ignition lock 205 is designed so that in a first position ("1" in FIG. 1), internal combustion engine controller 120 is switched on, and in a second position ("2" in FIG. 1), starter 141 is additionally actuated. A switch-off position ("0" in FIG. 1) of the ignition lock is also provided. An engine-speed pulse-generation wheel 145 disposed at internal combustion engine 100 is sampled by an engine-speed sensor 150, which supplies a corresponding speed signal to internal combustion engine controller 120.

Figure 2:
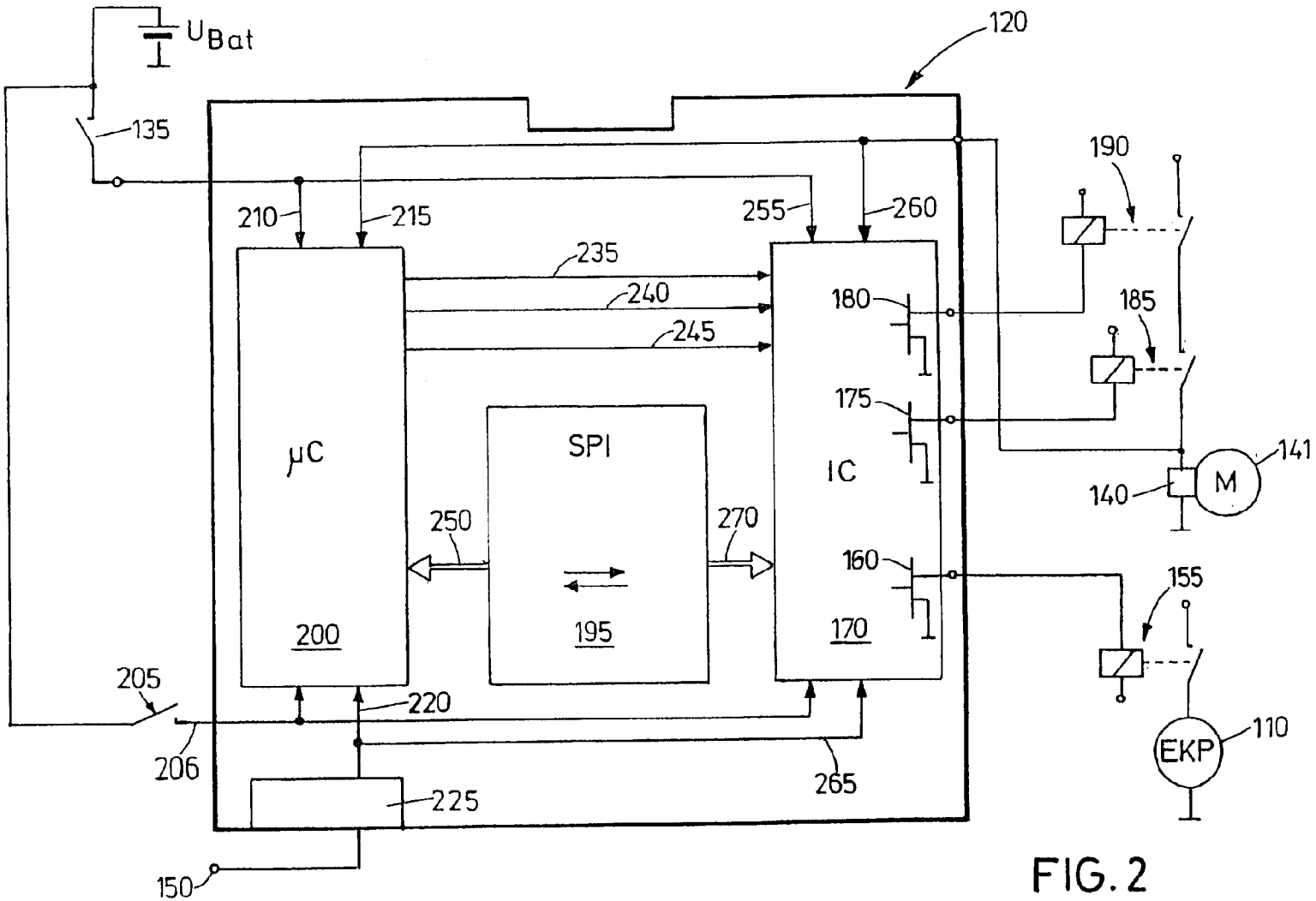
FIG. 2 shows schematically more precise details of the internal combustion engine controller.

FIG. 2 shows further details of internal combustion engine controller 120. Electric fuel pump 110 is triggered via a fuel pump relay 155. This is carried out by way of an EFP power transistor 160. The latter is a component of a hardware logic circuit 165 (see FIG. 3), which belongs to an integrated circuit (IC) 170 and shall be described in detail. Further components of IC 170 shown in FIG. 2 are two starter power transistors 175, 180 which trigger electromagnetic switch 140 of starter 141 via starter relays 185, 190.

IC 170 is connected to a main processor ($\mu$C) 200 via an interface unit (SPI) 195. Here, interface unit 195 provides in particular for a bidirectional data exchange of operating-parameter data for starting and for the operation of internal combustion engine 100.

Main processor 200 and IC 170 are activated via a switch in activation line 206 at ignition lock 205.

Main processor 200 has the following further inputs: a starter switch input 210 which is connected to starter switch 135, a starter feedback input 215 which is connected to the power side of starter relays 185, 190, and a speed input 220 which is connected to engine-speed sensor 150 via an engine-speed-signal conditioning unit 225.

Main processor 200 has a plurality of outputs that are connected to IC 170: starter activation lines 235, 240 for activating starter power transistors 175, 180, and an EFP activation line 245 for activating EFP power transistor 160.

Moreover, main processor 200 also has a bidirectional data port 250 for communication with interface unit 195.

In addition to activation line 206, IC 170 has the following inputs: a starter switch input 255 which is connected to starter switch 135, a starter feedback input 260 which is connected to the power side of starter relays 185, 190, and a speed input 265 which is connected to engine-speed sensor 150 via engine-speed-signal conditioning unit 225.

Moreover, IC 170 also has a bidirectional data port 270 for communication with interface unit 195.

Figure 3:
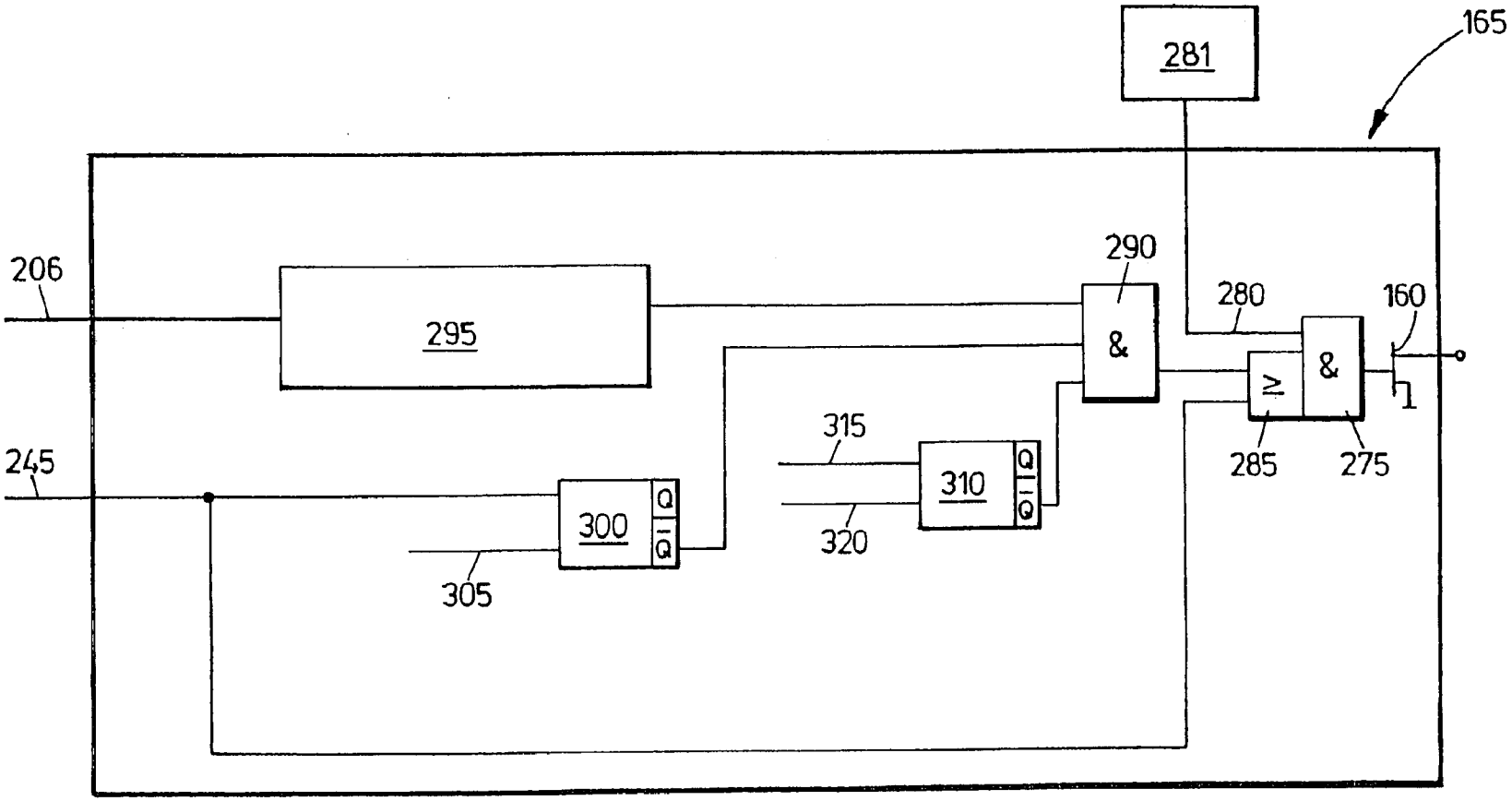
FIG. 3 shows a hardware logic circuit of the internal combustion engine controller.

In the following, hardware logic circuit 165 for triggering EFP power transistor 160 within IC 170 is described with reference to FIG. 3.

On the incoming side, EFP power transistor 160 is connected to the output of a first AND element 275. First AND element 275 has two inputs. A first input is connected to a reset line 280, via which a reset signal from a reset logic 281 is able to reliably switch off the power stage when the supply voltage of IC 170 does not have the minimum required value. During normal operation of hardware logic circuit 165, the reset line has an H-level (logic 1). The second input of AND element 275 is connected to the output of an OR element 285.

The OR element 285 has two inputs. The first input is connected to EFP activation line 245. The second input is connected to the output of a second logic AND element 290, which has a total of three inputs.

The first input of second AND element 290 is connected to activation line 206 via a preparatory (preliminary, advance, set-up) trigger unit 295. In the case of a switched EFP triggering, immediately after the signal on activation line 206 of ignition lock 205 goes to an H-level, preparatory trigger unit 295 likewise supplies a static H-level. The latter immediately switches on EFP power transistor 160 via second AND element 290 when the two other inputs of second AND element 290 have an H-level. The second input of second AND element 290 is connected to the inverted output of an initialization flip-flop 300 that is implemented as an RS flip-flop (set-reset flip-flop). Initialization flip-flop 300 is not continuously supplied with voltage via the supply (not shown) of main processor 200. Therefore, the switching state of initialization flip-flop 300 endures during an SG (switching device) overtravel, even after the decay of the activation signal on activation line 206, and is only reset (cleared) at the end of the SG overtravel.

The set input of initialization flip-flop 300 is connected to EFP activation line 245 of main processor 200. The reset input of initialization flip-flop 300 is connected by a starting-state line 305 by way of interface unit 195 to main processor 200, via which a starting-state signal is therefore able to be supplied. The third input of second AND element 290 is connected to the inverted output of a disturbance-state flip-flop 310 that is likewise implemented as an RS flip-flop. The set input and the reset input of disturbance-state flip-flop 310 are connected by a disturbance-state set line 315 and a disturbance-state reset line 320 via interface unit 195 to main processor 200, which is therefore able to supply a disturbance-state set signal or a disturbance-state reset signal to disturbance-state flip-flop 310. Disturbance-state flip-flop 310 is permanently supplied with power and therefore does not lose its state upon decay of the signal on activation line 206, even after the end of the overtravel.

Interface unit 195 (see FIG. 2) is used for transmitting data, stored in internal combustion engine controller 120, for the system configuration and for the control of IC 170. In addition to the signals described above, these data include: a time value $T_p$ which stands for an elongation of the possibly very short signal of starter switch 135 and a time value $T_v$ which stands for a delay of the signal of starter switch 135, that are implemented in a part (not shown more precisely here) of IC 170 for the starter triggering, whereby, after an activation signal via starter switch 135, starter power transistors 175, 180 in IC 170 are triggered in a possibly elongated and delayed manner; a speed threshold value which is used for distinguishing within internal combustion engine controller 120 whether a rotating engine is present or not; a time value $T_{ekpvl}$ of typically 300 $\mu$s which stands for a maximum preparatory duration within which hardware logic circuit 165 triggers fuel pump 110 via preparatory trigger unit 295 independently of main processor 200; as well as values for the frequency and for the pulse duty factor of a pulse-width-modulated signal that preparatory trigger unit 295 makes available in the case of a clocked triggering of fuel pump 110.

Diagnostic data of power transistors 160, 175, 180 are transmitted by interface unit 195 as return values from IC 170 to main processor 200.

Internal combustion engine controller 120 functions as follows:

First of all, ignition lock 205 is actuated for starting internal combustion engine 100. The actuation signal on activation line 206 triggers preparatory control unit trigger unit 295 which, in the case of a static, i.e., non-clocked EFP triggering, for time $T_{ckpvl}$ applies an H-level at the first input of second AND element 290. Upon the first actuation of activation line 206, initialization flip-flop 300 and disturbance-state flip-flop 310 are not set, so that an H-level is likewise present at their inverted outputs. Thus, in this operating state, an H-level is present at the output of second AND element 290, as well. Therefore, an H-level is present at the output of OR element 285, regardless of what kind of signal is present at EFP activation line 245. Since an H-level is likewise present on reset line 280, an H-level is also present at the output of first AND element 275, and EFP power transistor 160 is triggered immediately after actuation of activation line 206 and thus immediately after the buildup of the voltage supply of IC 170, so that fuel pump 110 runs immediately after ignition lock 205 is switched on and builds up the fuel pressure, even when, for example, the user cranks an ignition key used for actuating ignition lock 205, and therefore actuates starter switch 135 immediately after ignition lock 205 is switched on.

Prior to conclusion of the initialization of main processor 200, an L-level (low level) (logic 0) is present at EFP activation line 245. After the conclusion of the initialization of main processor 200, it switches EFP activation line 245 to an H-level in the case of a static, i.e. non-clocked EFP triggering. In this manner, initialization flip-flop 300 is set, so that the inverted output of initialization flip-flop 300 drops to an L-level. Therefore, an L-level is present at the output of second AND element 290, and therefore also at the first input of OR element 285. At the same time, however, an H-level is now applied at the second input of OR element 285 via EFP activation line 245, so that the output of OR element 285 is now no longer retained at an H-level via preparatory trigger unit 295, but rather via EFP activation line 245. Thus, after the initialization process, main processor 200 takes over the triggering of EFP power transistor 160, even before trigger time $T_{ekpvl}$ of preparatory trigger unit 295 has elapsed.

IC 170 and main processor 200 take over the control of the starting operation based on starter switch inputs 210, 255, and based on the output signal of engine-speed-signal conditioning unit 225. If main processor 200 detects that a start has been implemented due to a speed threshold value being reached, or that a certain time has elapsed after switching on the activation device, an H-level is applied on starting-state line 305. Therefore, initialization flip-flop 300 is automatically reset when the signal on EFP activation line 245 lies at an L-level or returns to it. Consequently, a direct triggering of fuel pump 110 via activation line 206 and preparatory trigger unit 295, as described above, is possible upon a new starting operation.

Therefore, the reset on starting-state line 305 is carried out in such a way that, given quickly repeating activation operations on activation line 206 without a start operation, no direct triggering of EFP power transistor 160 via activation line 206 is possible. Otherwise, a rapid repetition of this type, if it is carried out by the driver, may lead to noise annoyance, and if it happens due to an intermittent electrical contact, for example, after a crash with damage to the fuel circuit, may lead to dangerous fuel escape.

If main processor 200 detects a disturbance state, particularly the triggering of a crash sensor, an H-level is applied via disturbance-state set line 315 at the set input of disturbance-state flip-flop 310. The inverted output of disturbance-state flip-flop 310 therefore switches to an L-level, so that triggering of fuel pump 110 via activation line 206 is no longer possible, since an L-level is present at the third input, and therefore also at the output of second AND element 290. After return from the disturbance state to the normal state, i.e. when the crash signal stored in main processor 200 has been erased via a tester, disturbance-state flip-flop 310 is reset via an H-level on disturbance-state reset line 320.

Thus, if a crash signal of this type is stored in main processor 200, no EFP preparatory operation is carried out when ignition lock 205 is switched on. In this case, fuel pump 110 is only triggered again via main processor 200 when starter switch 135 has been actuated.

In accordance with time value $T_v$, starter power transistors 175, 180 may be triggered in a slightly time-delayed manner compared to the triggering of EFP power transistor 160, so that fuel pump 110 is able to build up the optimal fuel pressure for the start operation, uninfluenced by a drop in the supply voltage which is caused by the starter current upon active triggering of starter 141.

Hardware logic circuit 165 is designed so that it triggers EFP power transistor 160 selectively with a continuous signal or with a pulse-width-modulated signal. Pulse-width-modulated trigger signals of this kind are used for the operation of electric fuel pumps, in which the desired fuel pressure may be set via an automatic speed control of the electric fuel pump. Such electric fuel pumps are known as DECOS (demand controlled fuel supply system) EFP. DECOS fuel pumps of this type generally contain a monitoring logic which, in response to a correctly received pulse-width-modulated signal, controls the speed of the fuel pump as a function of the pulse-width pulse duty factor, and in the case of a static H-input or L-input level, switches off the DECOS-EFP, since a short-circuit may be present. Therefore, upon an initial start, thus, the first time internal combustion engine controller 120 is put into operation, when main processor 200 has not yet written any system parameters via interface unit 195 into the suitable, continuously power-supplied data memory of IC 170, initially no preparatory triggering by preparatory trigger unit 295 takes place, since IC 170 does not yet know whether a DECOS-EFP is present or not.

After each start, main processor 200 stores the data, specific for an operating cycle of internal combustion engine 100, via interface unit 195, in the continuously supplied data memories of IC 170, so that upon subsequent starts, it correctly carries out the aforesaid static preparatory control or the pulse-width-modulated preparatory control described in the following.

During the pulse-width-modulated operation, preparatory trigger unit 295 generates a pulse-width-modulated signal as a function of the values for the frequency and the pulse duty factor which were transmitted by main processor 200 to IC 170 after the preceding start. In this context, to optimize the buildup of the fuel pressure, main processor 200 may transmit as pulse duty factor a value which corresponds to a maximum speed of the DECOS-EFP. Therefore, at each following start, the corresponding pulse-width-modulated signal is transmitted via second AND element 290, OR element 285 and first AND element 275 with the stored values of frequency and pulse duty factor to EFP power transistor 160, even before main processor 200 is ready.

After the conclusion of the initialization process, main processor 200 takes over the pulse-width-modulated triggering of fuel pump 110 via EFP activation line 245. In this context, with the first rising edge of the pulse-width-modulated signal on EFP activation line 245, initialization flip-flop 300 is set so that an L-level is present at its inverted output, and thus the triggering of EFP power transistor 160 by preparatory trigger unit 295 is decoupled. At the same time, analogous to the description above, main processor 200 takes over the pulse-width-modulated triggering of EFP power transistor 160 via EFP activation line 245.

Due to the switching times of the logic modules and the usually missing phase matching of the pulse-width-modulated signals of preparatory trigger unit 295 on the one hand and of EFP activation line 245 on the other hand, during the takeover of the triggering of EFP power transistor 160 from preparatory trigger unit 295, a pulse duty factor which deviates from the normal pulse-width-modulated signal occurs on EFP activation line 245 during a short time span which is less than two period durations of the pulse-width-modulated signal.

Therefore, for operation with a DECOS-EFP, its fault-detection logic must be designed so that it recognizes a disturbance state only after three period durations having a pulse duty factor deviating from the normal pulse-width-modulated signal have elapsed.

The function of initialization flip-flop 300 and of disturbance-state flip-flop 310 is the storage of state (status) values which correspond to the starting state and the disturbance state, respectively, of internal combustion engine controller 120. In another exemplary embodiment, instead of IC 170 described, this storage may naturally also be implemented by other components, e.g. RC elements, which take over the storage of states by charging a capacitor that discharges with a predefinable time constant. For an RC element (or arrangement) which replaces initialization flip-flop 300, the time constant is selected so that, analogous to the description above, rapidly successive activations on activation line 206 do not directly trigger EFP power transistor 160. An RC element (or arrangement) which replaces disturbance-state flip-flop 310 may have a comparatively long time constant; given an active disturbance state, this RC element (or arrangement) is continuously charged by main processor 200 during the overtravel, and only discharges as of the end of the overtravel.

As an alternative to hardware logic circuit 165, a triggering processor (not shown), independent of main processor 200, may be provided. It has a simpler construction compared to main processor 200, and has a very short initialization duration compared to main processor 200. During the initialization of main processor 200, the triggering processor takes over the triggering of EFP power transistor 160. The triggering processor may likewise have a continuously supplied flip-flop for the storage of states, so that in response to a disturbance state, the triggering processor is prevented from triggering fuel pump 110 independently during the initialization of main processor 200. As an alternative to a flip-flop, the use of an RC element (or arrangement) in the form described may also be used.

What is claimed is:

1. An internal combustion engine controller comprising:

a main processor for monitoring operating parameters of the internal combustion engine;

a triggering device, working together with the main processor, for an electric fuel pump of an internal combustion engine, wherein the triggering device works together with an electric activation device for the main processor and operates so that the electric fuel pump is triggered essentially without time delay after the activation device is actuated; and a switching device that is operable, during an initialization process of the main processor, to trigger the electric fuel pump independently of the main processor.

2. The internal combustion engine controller of claim 1, wherein the switching device operates so that the triggering of the electric fuel pump is only performed when there is no disturbance state.

3. The internal combustion engine controller of claim 1, wherein the switching device operates so that the triggering of the electric fuel pump is only performed once after the activation device is actuated, and another triggering is only permitted when a start is detected or the activation device has not been actuated for a predefined time span.

4. The internal combustion engine controller of claim 1, further comprising:

a detecting arrangement to detect whether a starting of the internal combustion engine, the detecting arrangement including an engine-speed-signal conditioning unit, connected to an engine-speed sensor, whose output is recorded by the main processor and monitored for a speed threshold value being exceeded.

5. The internal combustion engine controller of claim 1, wherein the switching device includes a logic circuit and a power stage for triggering the electric fuel pump.

6. The internal combustion engine controller of claim 5, wherein the switching device includes an OR arrangement, which includes a main-processor triggering input that is connected to an electric fuel pump activation line of the main processor, and a control input for the triggering of the electric fuel pump independently of the main processor, the control input being triggered essentially without time delay in response to the activation device being actuated via an activation line by a control unit for triggering the electric fuel pump independently of the main processor.

7. The internal combustion engine controller of claim 6, wherein a signal of the control unit is carried via an AND arrangement, which includes an input having an H-level when certain stipulations are satisfied with respect to an operating state of the internal combustion engine controller.

8. The internal combustion engine controller of claim 7, wherein the switching device includes a bi-stable initialization toggle switch as a switching unit, whose output has an L-level prior to the actuation of the activation device, whose set input is connected to the electric fuel pump activation line so that the toggle switch is set in response to a triggering of the electric fuel pump by the main processor, whose reset input is triggered via a reset line by the main processor so that the toggle switch is reset upon detecting a start or a predefined time span after the activation device is actuated, and whose inverted output is connected to the input of the AND arrangement.

9. The internal combustion engine controller of claim 8, wherein the control unit is operable to trigger the electric fuel pump independently of the main processor only for a time span which is a predefined period of time longer than an initialization time of the main processor, which takes over the triggering of the electric fuel pump prior to the time span expiring, and at the same time, the triggering of the electric fuel pump independently of the main processor is decoupled by setting the toggle switch via the AND arrangement.

10. The internal combustion engine controller of claim 8, wherein the toggle switch is an RC arrangement that provides state storage.

11. The internal combustion engine controller of claim 7, wherein the logic circuit includes a bi-stable disturbance-state toggle switch as a logic switching unit, whose output has an L-level prior to the actuation of the activation device, whose set input and whose reset input are connected to the main processor via an interface unit, and whose output, if there is a disturbance state of the internal combustion engine controller, is set via the set input, and upon termination of the disturbance state, is reset via the reset input, and whose inverted output is connected to the input of the AND arrangement.

12. The internal combustion engine controller of claim 11, wherein the disturbance-state toggle switch includes a permanent power supply that is independent of the activation device.

13. The internal combustion engine controller of claim 11, wherein the disturbance-state toggle switch is a disturbance-state RC arrangement having a predefined time constant.

14. The internal combustion engine controller of claim 1, wherein the electric fuel pump is statically triggerable, and the control unit for the triggering of the electric fuel pump independently of the main processor outputs a static signal until the main processor takes over.

15. The internal combustion engine controller of claim 1, wherein the switching device operates so that the electric fuel pump is triggered via a pulse-width-modulated signal determining the speed of the electric fuel pump, and the control unit for the triggering of the electric fuel pump independently of the main processor outputs a pulse-width signal, having a predefinable frequency and predefinable pulse duty factor, until the main processor takes over.

16. The internal combustion engine controller of claim 15, wherein the control unit for the triggering of the electric fuel pump independently of the main processor operates so that the output pulse duty factor corresponds to a maximum speed of the fuel pump, which is triggerable using pulse-width-modulation.

17. The internal combustion engine controller of claim 15, wherein the control unit for the triggering of the electric fuel pump independently of the main processor includes a permanent storage unit for providing at least one of (i) a static triggering or a pulse-width-modulated triggering and (ii) a value corresponding to the pulse duty factor and a period duration, which is such that after an effected start, the main processor writes the storage values into the storage unit for the triggering of the electric fuel pump independently of the main processor, the storage values being interpreted upon a following start.

18. The internal combustion engine controller of claim 1, wherein the electronic switching device includes a triggering processor independent of the main processor.

19. The internal combustion engine controller of claim 18, wherein the triggering processor includes at least one state-RC arrangement for providing buffer storage of an operating state, a starting state or a disturbance state, which are monitored within the internal combustion engine controller.

20. The internal combustion engine controller of claim 1, wherein a time-delay arrangement operates so that a starter of the internal combustion engine is only triggerable after a predefinable delay time after the activation device is actuated.

21. The internal combustion engine controller of claim 20, wherein the delay time is about 300 ms.

22. A method for operating an internal combustion engine controller, the method comprising:

triggering an electric fuel pump with a triggering device and an electric activation device, which works together with it, essentially without time delay after the electric activation device is actuated, the triggering of the electric fuel pump being done independently of a main processor by a switching device during the initialization process of the main processor;

wherein the internal combustion engine controller includes:

the main processor for monitoring operating parameters of the internal combustion engine, the triggering device, which works together with the main processor, for the electric fuel pump of the internal combustion engine, and which works together with the electric activation device for the main processor and operates so that the electric fuel pump is triggered essentially without time delay after the activation device is actuated, and the switching device is operable, during an initialization process of the main processor, to trigger the electric fuel pump independently of the main processor.

23. An internal combustion engine controller comprising:

a main processor for monitoring operating parameters of the internal combustion engine;

a triggering device, working together with the main processor, for an electric fuel pump of an internal combustion engine, wherein the triggering device works together with an electric activation device and operates so that the electric fuel pump is triggered essentially without time delay after the activation device is actuated; and a switching device that is operable, during an initialization process of the main processor, to trigger the electric fuel pump independently of the main processor, wherein the switching device operates so that the triggering of the electric fuel pump is only performed once after the activation device is actuated, and another triggering is only permitted when a start is detected or the activation device has not been actuated for a predefined time span.

24. The internal combustion engine controller of claim 23, wherein the switching device operates so that the triggering of the electric fuel pump is only performed when there is no disturbance state.

25. The internal combustion engine controller of claim 23, further comprising:

a detecting arrangement to detect whether a starting of the internal combustion engine, the detecting arrangement including an engine-speed-signal conditioning unit, connected to an engine-speed sensor, whose output is recorded by the main processor and monitored for a speed threshold value being exceeded.

26. The internal combustion engine controller of claim 23, wherein the switching device includes a logic circuit and a power stage for triggering the electric fuel pump.

27. The internal combustion engine controller of claim 26, wherein the switching device includes an OR arrangement, which includes a main-processor triggering input that is connected to an electric fuel pump activation line of the main processor, and a control input for the triggering of the electric fuel pump independently of the main processor, the control input being triggered essentially without time delay in response to the activation device being actuated via an activation line by a control unit for triggering the electric fuel pump independently of the main processor.

28. The internal combustion engine controller of claim 27, wherein a signal of the control unit is carried via an AND arrangement, which includes an input having an H-level when certain stipulations are satisfied with respect to an operating state of the internal combustion engine controller.

29. The internal combustion engine controller of claim 28, wherein the switching device includes a bi-stable initialization toggle switch as a switching unit, whose output has an L-level prior to the actuation of the activation device, whose set input is connected to the electric fuel pump activation line so that the toggle switch in set in response to a triggering of the electric fuel pump by the main processor, whose reset input is triggered via a reset line by the main processor so that the toggle switch is reset upon detecting a start or a predefined time span after the activation device is actuated, and whose inverted output is connected to the input of the AND arrangement.

30. The internal combustion engine controller of claim 29, wherein the control unit is operable to trigger the electric fuel pump independently of the main processor only for a time span which is a predefined period of time longer than an initialization time of the main processor, which takes over the triggering of the electric fuel pump prior to the time span expiring, and at the same time, the triggering of the electric fuel pump independently of the main processor is decoupled by setting the toggle switch via the AND arrangement.

31. The internal combustion engine controller of claim 29, wherein the toggle switch is an RC arrangement that provides state storage.

32. The internal combustion engine controller of claim 28, wherein the AND arrangement includes a bi-stable disturbance-state toggle switch as a logic switching unit, whose output has an L-level prior to the actuation of the activation device, whose set input and whose reset input are connected to the main processor via an interface unit, and whose output, if there is a disturbance state of the internal combustion engine controller, is set via the set input, and upon termination of the disturbance state, is reset via the reset input, and whose inverted output is connected to the input of the AND arrangement.

33. The internal combustion engine controller of claim 32, wherein the disturbance-state toggle switch includes a permanent power supply that is independent of the activation device.

34. The internal combustion engine controller of claim 32, wherein the disturbance-state toggle switch is a disturbance-state RC arrangement having a predefined time constant.

35. The internal combustion engine controller of claim 23, wherein the electric fuel pump is statically triggerable, and the control unit for the triggering of the electric fuel pump independently of the main processor outputs a static signal until the main processor takes over.

36. The internal combustion engine controller of claim 23, wherein the switching device operates so that the electric fuel pump is triggered via a pulse-width-modulated signal determining the speed of the electric fuel pump, and the control unit for the triggering of the electric fuel pump independently of the main processor outputs a pulse-width signal, having a predefinable frequency and predefinable pulse duty factor, until the main processor takes over.

37. The internal combustion engine controller of claim 36, wherein the control unit for the triggering of the electric fuel pump independently of the main processor operates so that the output pulse duty factor corresponds to a maximum speed of the fuel pump, which is triggerable using pulse-width-modulation.

38. The internal combustion engine controller of claim 36, wherein the control unit for the triggering of the electric fuel pump independently of the main processor includes a permanent storage unit for providing at least one of (i) a static triggering or a pulse-width-modulated triggering and (ii) a value corresponding to the pulse duty factor and a period duration, which is such that after an effected start, the main processor writes the storage values into the storage unit for the triggering of the electric fuel pump independently of the main processor, the storage values being interpreted upon a following start.

39. The internal combustion engine controller of claim 23, wherein the electronic switching device includes a triggering processor independent of the main processor.

40. The internal combustion engine controller of claim 39, wherein the triggering processor includes at least one state-RC arrangement for providing buffer storage of an operating state, a starting state or a disturbance state, which are monitored within the internal combustion engine controller.

41. The internal combustion engine controller of claim 23, wherein a time-delay arrangement operates so that a starter of the internal combustion engine is only triggerable after a predefinable delay time after the activation device is actuated.

42. The internal combustion engine controller of claim 41, wherein the delay time is about 300 ms.

43. A method for operating an internal combustion engine controller, the method comprising:

triggering an electric fuel pump with a triggering device and an electric activation device, which works together with it, essentially without time delay after the electric activation device is actuated, the triggering of the electric fuel pump being done independently of a main processor by a switching device during the initialization process of the main processor;

wherein the internal combustion engine controller includes:

the main processor for monitoring operating parameters of the internal combustion engine, the triggering device, which works together with the main processor, for the electric fuel pump of the internal combustion engine, and which works together with the electric activation device and operates so that the electric fuel pump is triggered essentially without time delay after the activation device is actuated, and the switching device is operable, during an initialization process of the main processor, to trigger the electric fuel pump independently of the main processor wherein the switching device operates so that the triggering of the electric fuel pump is only performed once after the activation device is actuated, and another triggering is only permitted when a start is detected or the activation device has not been actuated for a predefined time span.

44. An internal combustion engine controller comprising:

a main processor for monitoring operating parameters of the internal combustion engine;

a triggering device, working together with the main processor, for an electric fuel pump of an internal combustion engine, wherein the triggering device works together with an electric activation device and operates so that the electric fuel pump is triggered essentially without time delay after the activation device is actuated; and a switching device that is operable, during an initialization process of the main processor, to trigger the electric fuel pump independently of the main processor, wherein the switching device operates so that the electric fuel pump is triggered via a pulse-width-modulated signal determining the speed of the electric fuel pump, and the control unit for the triggering of the electric fuel pump independently of the main processor outputs a pulse-with signal, having a predefinable frequency and predefinable pulse duty factor, until the main processor takes over.

45. The internal combustion engine controller of claim 44, wherein the switching device operates so that the triggering of the electric fuel pump is only performed when there is no disturbance state.

46. The internal combustion engine controller of claim 44, wherein the switching device operates so that the triggering of the electric fuel pump is only performed once after the activation device is actuated, and another triggering is only permitted when a start is detected or the activation device has not been actuated for a predefined time span.

47. The internal combustion engine controller of claim 44, further comprising: a detecting arrangement to detect whether a starting of the internal combustion engine, the detecting arrangement including an engine-speed-signal conditioning unit, connected to an engine-speed sensor, whose output is recorded by the main processor and monitored for a speed threshold value being exceeded.

48. The internal combustion engine controller of claim 44, wherein the switching device includes a logic circuit and a power stage for triggering the electric fuel pump.

49. The internal combustion engine controller of claim 48, wherein the switching device includes an OR arrangement, which includes a main-processor triggering input that is connected to an electric fuel pump activation line of the main processor, and a control input for the triggering of the electric fuel pump independently of the main processor, the control input being triggered essentially without time delay in response to the activation device being actuated via an activation line by a control unit for triggering the electric fuel pump independently of the main processor.

50. The internal combustion engine controller of claim 49, wherein a signal of the control unit is carried via an AND arrangement, which includes an input having an H-level when certain stipulations are satisfied with respect to an operating state of the internal combustion engine controller.

51. The internal combustion engine controller of claim 50, wherein the switching device includes a bi-stable initialization toggle switch as a switching unit, whose output has an L-level prior to the actuation of the activation device, whose set input is connected to the electric fuel pump activation line so that the toggle switch is set in response to a triggering of the electric fuel pump by the main processor, whose reset input is triggered via a reset line by the main processor so that the toggle switch is reset upon detecting a start or a predefined time span after the activation device is actuated, and whose inverted output is connected to the input of the AND arrangement.

52. The internal combustion engine controller of claim 51, wherein the control unit is operable to trigger the electric fuel pump independently of the main processor only for a time span which is a predefined period of time longer than an initialization time of the main processor, which takes over the triggering of the electric fuel pump prior to the time span expiring, and at the same time, the triggering of the electric fuel pump independently of the main processor is decoupled by setting the toggle switch via the AND arrangement.

53. The internal combustion engine controller of claim 51, wherein the toggle switch is an RC arrangement that provides state storage.

54. The internal combustion engine controller of claim 50, wherein the logic circuit includes a bi-stable disturbance-state toggle switch as a logic switching unit, whose output has an L-level prior to the actuation of the activation device, whose set input and whose reset input are connected to the main processor via an interface unit, and whose output, if there is a disturbance state of the internal combustion engine controller, is set via the set input, and upon termination of the disturbance state, is reset via the reset input, and whose inverted output is connected to the input of the AND arrangement.

55. The internal combustion engine controller of claim 54, wherein the disturbance-state toggle switch includes a permanent power supply that is independent of the activation device.

56. The internal combustion engine controller of claim 54, wherein the disturbance-state toggle switch is a disturbance-state RC arrangement having a predefined time constant.

57. The internal combustion engine controller of claim 44, wherein the control unit for the triggering of the electric fuel pump independently of the main processor operates so that the output pulse duty factor corresponds to a maximum speed of the fuel pump, which is triggerable using pulse-width-modulation.

58. The internal combustion engine controller of claim 44, wherein the control unit for the triggering of the electric fuel pump independently of the main processor includes a permanent storage unit for providing at least one of (i) a static triggering or a pulse-width-modulated triggering and (ii) a value corresponding to the pulse duty factor and a period duration, which is such that after an effected start, the main processor writes the storage values into the storage unit for the triggering of the electric fuel pump independently of the main processor, the storage values being interpreted upon a following start.

59. The internal combustion engine controller of claim 44, wherein the electronic switching device includes a triggering processor independent of the main processor.

60. The internal combustion engine controller of claim 59, wherein the triggering processor includes at least one state-RC arrangement for providing buffer storage of an operating state, a starting state or a disturbance state, which are monitored within the internal combustion engine controller.

61. The internal combustion engine controller of claim 44, wherein a time-delay arrangement operates so that a starter of the internal combustion engine is only triggerable after a predefinable delay time after the activation device is actuated.

62. The internal combustion engine controller of claim 61, wherein the delay time is about 300 ms.

63. A method for operating an internal combustion engine controller, the method comprising:

triggering an electric fuel pump with a triggering device and an electric activation device, which works together with it, essentially without time delay after the electric activation device is actuated, the triggering of the electric fuel pump being done independently of a main processor by a switching device during the initialization process of the main processor;

wherein the internal combustion engine controller includes:

the main processor for monitoring operating parameters of the internal combustion engine, the triggering device, which works together with the main processor, for the electric fuel pump of the internal combustion engine, and which works together with the electric activation device and operates so that the electric fuel pump is triggered essentially without time delay after the activation device is actuated, and the switching device is operable, during an initialization process of the main processor, to trigger the electric fuel pump independently of the main processor, wherein the switching device operates so that the electric fuel pump is triggered via a pulse-width-modulated signal determining the speed of the electric fuel pump, and the control unit for the triggering of the electric fuel pump independently of the main processor outputs a pulse-width signal, having a predefinable frequency and predefinable pulse duty factor, until the main processor takes over.

* * * * *